US007012181B2

(12) United States Patent
Tran

(10) Patent No.: US 7,012,181 B2
(45) Date of Patent: Mar. 14, 2006

(54) CAPO SYSTEM

(76) Inventor: John D. Tran, 304 Birch Grove, Irvine, CA (US) 92618

( * ) Notice: Subject to any disclaimer, the term of this patent is extended or adjusted under 35 U.S.C. 154(b) by 182 days.

(21) Appl. No.: 10/810,398

(22) Filed: Mar. 25, 2004

(65) Prior Publication Data

US 2005/0098019 A1 May 12, 2005

Related U.S. Application Data

(60) Provisional application No. 60/519,402, filed on Nov. 12, 2003.

(51) Int. Cl.
*G10D 3/00* (2006.01)

(52) U.S. Cl. ..... 84/318

(58) Field of Classification Search ..... 84/318, 84/312 R, 316, 317, 315; 248/229.2, 229.22, 248/229.3–229.26, 226.11
See application file for complete search history.

(56) References Cited

U.S. PATENT DOCUMENTS 4,149,443 A * 4/1979 Bringe ..... 84/318
4,583,440 A 4/1986 Powell, Jr.
6,835,880 B1 * 12/2004 Silva ..... 84/318

* cited by examiner

*Primary Examiner*—Kimberly Lockett

(57) ABSTRACT

A capo system for incorporating the advantages of a spring loaded short cut capo and a spring loaded regular capo into one convenient spring loaded capo system, while maintaining the ability to move both both capos with one hand and improving the comfortability when squeezing the capo by incorporating padding and comfort grooves. The inventive device includes a regular spring loaded capo with top and bottom jaws and a protruding portion, a spring loaded short cut capo with top and bottom jaws and a protruding portion and a plurality of attachments that connect both spring loaded capos together. The short cut capo consists of a spring loaded capo that is altered in a way to allow the certain strings on a guitar to be remained unclamped, while the remainder of the strings are closed down. The regular spring loaded capo is a spring loaded capo that is unaltered to ensure proper closing down on all strings of a guitar. The regular capo and short cut capo are connected to each other by a plurality of attachments that provide stability and support during the simultaneous opening and closing of both capos and ensure that both capos remain at a preset fixed distance from each other. The plurality of attachments may also include elastomeric pads and grooves to increase comfortability and support when squeezing the plurality of attachments.

9 Claims, 6 Drawing Sheets

CAPO SYSTEM

This application claims benefit of 60/519,402 filed Nov. 12, 2003.

BACKGROUND OF THE INVENTION

1. Field of the Invention

The present invention relates generally to guitar capos and more specifically it relates to a capo system for incorporating the advantages of a spring loaded short cut capo and a spring loaded regular capo into one convenient spring loaded capo system, while maintaining the ability to move both capos with one hand and improving the comfortability when squeezing the capo by incorporating padding and comfort grooves.

2. Description of the Related Art

It can be appreciated that guitar capos have been in use for years. Typically, guitar capos are comprised of capos having screws, cams or spring loaded clamps for attaching the device to the instrument neck to change their pitch. Spring loaded clamps have become popular because they can be opened and moved to a new position with one hand. A regular spring loaded capo as referenced and disclosed in U.S. Pat. No. 4,583,440 clamps down on all strings at once to allow the pitch of the instrument to be changed. Another type of spring loaded clamp is the short cut capo, which is altered in a way that allows the low E string (String 6) and high B (String 2) and high E string (String 1) to remain unclamped while clamping down the remaining strings on a six string guitar. This allows for chord voicings different from standard open chords and often calls for very simple fingerings which makes the chords easier for beginning players. This allows the musician the ability to play a variety of chords with less effort and adds to the enjoyability of the guitar.

The main problem with conventional guitar capos are that until now there have been no available capo system that incorporate the advantages of using both the regular spring loaded capo and the short cut capo simultaneously into one convenient capo system, while still maintaining the ability to move the both capos with one hand. Another problem with conventional guitar capos are that until now, the short cut capo was primarily designed to be placed on the 2nd fret of a standard tuned (EADGBE) guitar. In order to change the pitch of the guitar while still incorporating the characteristics of the short cut capo involved the use of a regular spring loaded capo in conduction with the short cut capo. Although this remedied the problem of changing the pitch with a short cut capo, it required the use of two hands to move both capos simultaneously to different frets upon the guitar, which nullified the advantages of a spring loaded capo to easily and coveniently move a capo with one hand and disrupts the performance of the musician. Another problem with conventional guitar capos are that prior spring loaded capos required long handles that were uncomfortable to squeeze because of the angle and design of the handles.

While these devices may be suitable for the particular purpose to which they address, they are not as suitable for incorporating the advantages of a spring loaded short cut capo and a regular spring loaded capo into one convenient spring loaded capo system.

In these respects, the capo system according to the present invention substantially departs from the conventional concepts and designs of the prior art, and in so doing provides an apparatus primarily developed for the purpose of incorporating the advantages of the spring loaded short cut capo and the spring loaded regular capo into one convenient spring loaded capo system, while maintaining the ability to move both capos with one hand and improving the comfortability when squeezing the capo by incorporating padding and comfort grooves.

SUMMARY OF THE INVENTION

In view of the foregoing disadvantages inherent in the known types of guitar capos now present in the prior art, the present invention provides a new capo system construction wherein the same can be utilized for incorporating the advantages of the spring loaded short cut capo and the spring loaded regular six string capo into one convenient spring loaded capo system, while maintaining the ability to move both capos with one hand and improving the comfortability when squeezing the capo by incorporating padding and comfort grooves.

The general purpose of the present invention, which will be described subsequently in greater detail, is to provide a new capo system that has many of the advantages of the guitar capos mentioned heretofore and many novel features that result in a new capo system which is not anticipated, rendered obvious, suggested, or even implied by any of the prior art guitar capos, either alone or in any combination thereof.

To attain this, the present invention generally comprises a regular spring loaded capo with a top and bottom jaw and a protruding portion, a short cut capo with a top and bottom jaw and a protruding portion and a plurality of attachments that connect both spring loaded capos together. The short cut capo consists of a spring loaded capo, that is altered in a way to allow the certain strings on a guitar to be remained unclamped, while the remainder of the strings are clamped down. The short cut capo is attached to the plurality of attachments, which is connected to the regular capo. The regular capo is a spring loaded capo that is unaltered in any way, to ensure proper closing down on all strings of a guitar. The regular capo and short cut capo are connected to each other by a plurality of attachments that provide stability and support during the opening and closing of both capos simultaneously. The plurality of attachments also ensure that both capos remain at a preset fixed distance from each other and open and close at the same time. The plurality of attachments may also include elastomeric materials and comfort grooves to provide further comfortability and support when opening and closing both capos.

There has thus been outlined, rather broadly, the more important features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a capo system that will overcome the shortcomings of the prior art devices.

Another object of the present invention is to provide a capo system for incorporating the advantages of a spring loaded short cut capo and a spring loaded regular capo into one convenient spring loaded capo system.

Another object is to provide a capo system that incorporates the advantages of simultaneously using a short cut spring loaded capo and a regular spring loaded capo while still allowing both capos to be moved by one hand.

Another object is to provide a capo system that includes padding and grooves on the plurality of attachments that connect both spring loaded capos together, which provides greater comfortability and support.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein:

FIG. 5 is a perspective view of the capo system in a closed position affixed on the neck of the guitar.

DETAILED DESCRIPTION OF THE INVENTION

Figure 1:
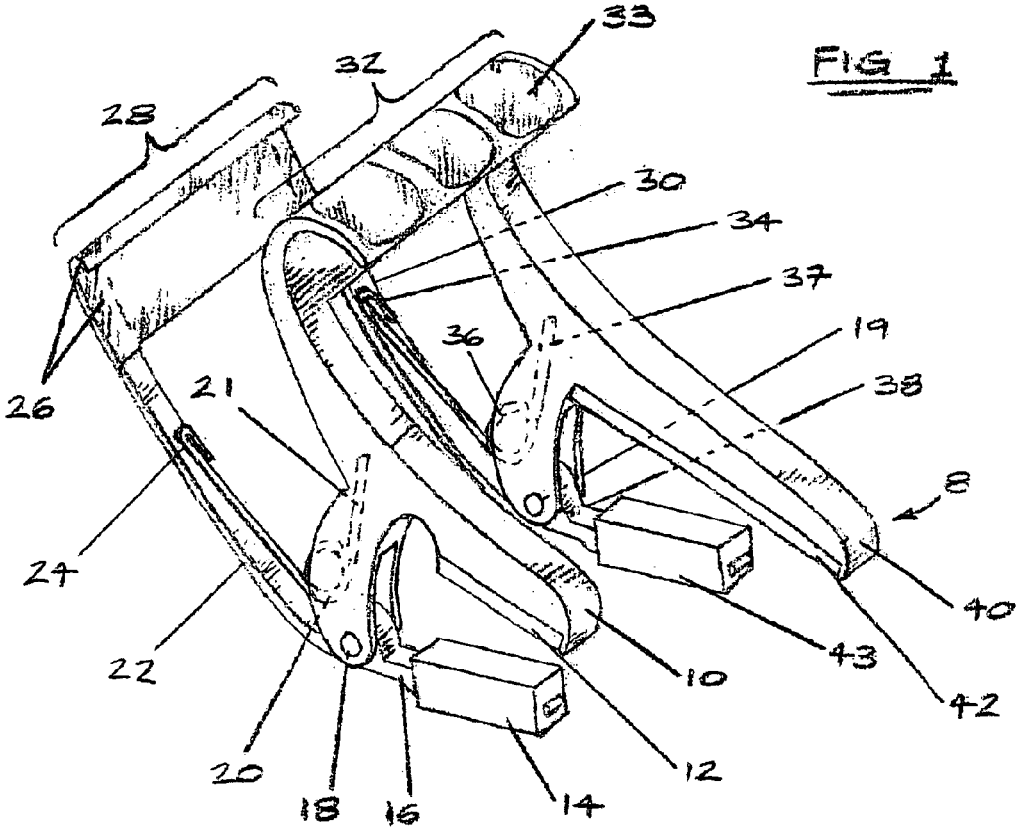
FIG. 1 is a perspective view of the capo system embodying the features of the invention.

Turning now descriptively to the drawings, in which similar reference characters denote similar elements throughout the several views, the attached figures illustrate a capo system, which comprises a regular spring loaded regular capo with top and bottom jaws and a protruding portion, a short cut capo with top and bottom jaws and a protruding portion and a plurality of attachments that connect both spring loaded capos together. The short cut capo consists of a spring loaded regular capo, that is altered in a way to allow the certain strings on a guitar to be remained unclamped, while the remainder of the strings are closed down. The short cut capo is attached to the plurality of attachments, which is connected to the regular capo. The regular capo is a spring loaded capo that is unaltered in any way, to ensure proper closing down on all strings of a guitar. The regular capo and the short cut capo are connected to each other by a plurality of attachments that provide stability and support during the opening and closing of both capos simultaneously. The plurality of attachments also ensure that both capos remain at a preset fixed distance from each other and open and close at the same time. The plurality of attachments may also contain elastomeric materials and comfort grooves to provide further comfortability and support when opening and closing both capos.

The short cut capo consist of a spring loaded regular capo, that is altered in a way to allow the certain strings on a guitar to be remained unclamped, while the remainder of the strings are closed down. The short cut capo is attached to the plurality of attachments, which is connected to the regular spring loaded capo. A first embodiment of the capo system incorporating the short cut capo of the present invention is illustrated in FIG. 1 and indicated generally at 8, Referring to FIG. 7, where the neck 48 of a guitar (including strings 44 and the Fret board 46) is shown clamped between top jaw 10 and bottom jaw 16. The jaws (10 and 16) are both preferably lined with elastomeric pads (42 and 14). Both pads prevent the neck from being marred and assures proper clamping. In this present embodiment, pad 12 and top jaw 10 in particular, are altered or "cut" in a way to clamp down on strings 3, 4 and 5 on a regular six string guitar but allows the remaining strings 1, 2 and 6 to remain unclamped. The bottom jaw 16 abuts the neck 48 and applies opposite pressure to the neck 48 against the pressure applied to the string 44 by the top jaw 10. The bottom jaw 16 is pivotedly attached to top jaw 10 at pin 18. Torsion spring 20 bears against the inside of the top jaw 10 tending to close the jaws and thereby applying enough pressure for top jaw 10 and bottom jaw 16 to properly clamp down on the strings 44 and neck 48. As shown in FIG. 1, a protruding portion 22 attaches the bottom jaw 16 to the plurality of attachments 28. The top jaw 10 is also attached to the plurality of attachements 32. In this present embodiment, the short cut capo is altered in a way to allow the low E string and the high B and E strings on a standard six string guitar to remain unclamped, while the remaining strings are clamped. The short cut capo may also be altered in a variety of different ways to perform the same function on different stringed instruments. The short cut capo may also be altered in a way to allow different strings to remain unclamped while clamping down on other strings, other than the low E and high B and E strings. The short cut capo may also be attached to the plurality of attachments in a different position than what is shown in the present embodiment.

Figure 8:
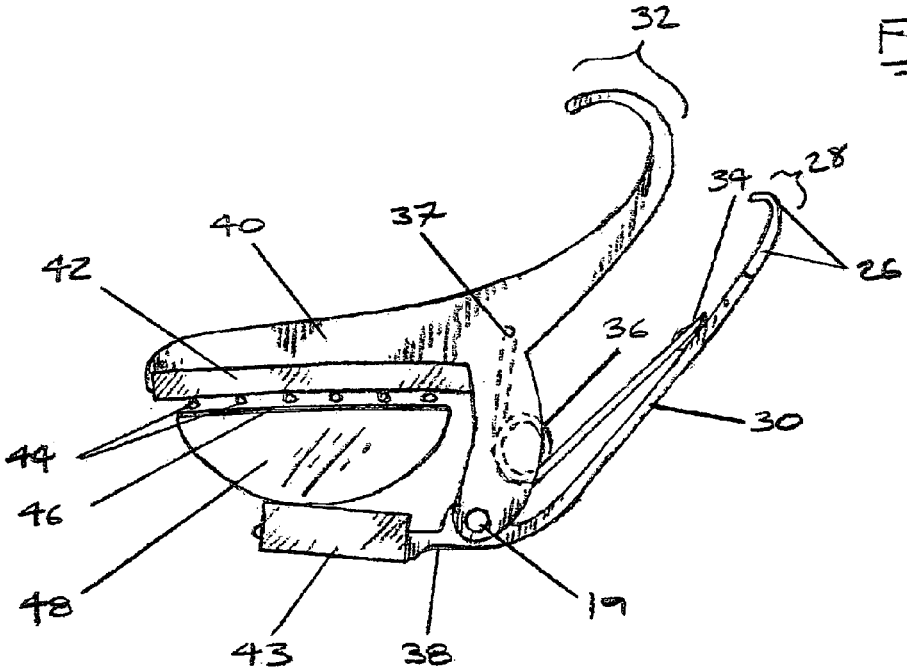
FIG. 8 is the regular capo side of FIG. 1 in closed position affixed on the neck of the guitar.

The regular capo is a spring loaded capo that is unaltered in any way, to ensure proper closing down on all strings of a guitar. Referring to FIG. 1, the top jaw 40 and bottom jaw 38 are lined with elastomeric pads (42 and 43). Both pads prevent the neck 48 from being marred and assures proper clamping. Referring to FIG. 8, in this present embodiment, the regular capo's top jaw 40 is not altered in any way to ensure that all six strings 44 on a regular six string guitar is clamped down. The bottom jaw 38 abuts the neck 48 and applies opposite pressure to the neck 48 against the pressure applied to the strings 44 by the top jaw 40 of the regular capo. The bottom jaw 38 is pivotedly attached to top jaw 40 at pin 19. Torsion spring 36 bears against the inside of top jaw 40 tending to close the jaws and thereby applying enough pressure for top jaw 40 and bottom jaw 38 to properly clamp down on the strings 44 and neck 48. As shown in FIG. 1 and FIG. 8, a protruding portion 30 attaches the bottom jaw 38 to the plurality of attachments 28. The top jaw 40 is also attached to the plurality of attachments 32. In this present embodiment, the regular capo is sized to clamp down all strings on a regular six string guitar. The regular capo may also be made in different sizes to fit larger or smaller guitars. The regular capo may also be attached to the plurality of attachments in a different position than what is shown in this present embodiment.

Figure 2:
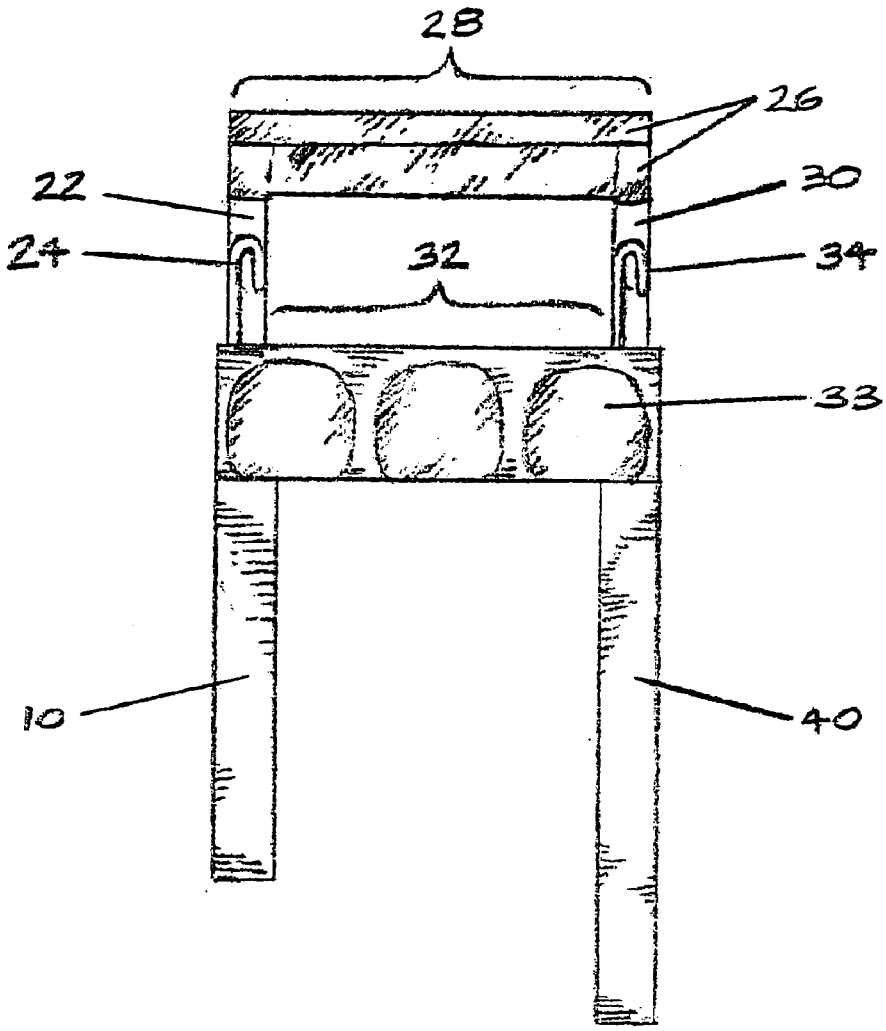
FIG. 2 is a elevational top down view.

The regular capo and short cut capo are connected to each other by a plurality of attachments that provide stability and support during the opening and closing of both capos simultaneously. The plurality of attachments also ensure that both capos remain at a preset fixed distance from each other and open and close at the same time. The plurality of attachments may also include rubber or sponge like materials to provide further comfortability and support when opening and closing both capos. The plurality of attachments may also include grooves that increase comfortability and support when squeezing the plurality of attachments. As shown best in FIG. 1 and FIG. 2, the plurality of attachments 28 and 33 are both attached to the protruding handles 22 and 30 and the top jaws 10 and 40. The plurality of attachments 32 has a plurality of grooves 33 that provide comfort and support and in this present embodiment are lined with an elastomeric material that also provides comfort and support. In this present embodiment, the plurality of attachments 28 is also lined with elastomeric material 26 to provide comfort and support. The plurality of attachments may also be positioned in a variety of ways, so long as they ensure that both spring loaded capos open and close simultaneously and remain at a fixed distance. The plurality of attachments could also be made to be adjustable which would provide flexibility in determining the fixed distance between both spring loaded capos.

Referring to FIG. 1, in this present embodiment, the top jaws 10 and 40 are pivotedly attached to bottom jaws 16 and 38 via the pins 18 and 19. Both coiled springs 20 and 36 are attached to two lower appendages at attachment points 37 and 21 and are similarly attached to both protruding portions at attachment points 24 and 34. The plurality of attachments 28 connects the protruding handle 22 with protruding handle 30, while the plurality of attachments 32 connects the top jaw 10 with top jaw 40. The plurality of attachments may also be attached to the protruding portions and top jaws at different points than what is shown in this present embodiment. The attachment points that connect the coiled springs with both top jaws and protruding handles may also be at different points than what is shown in this present embodiment.

Figure 3:
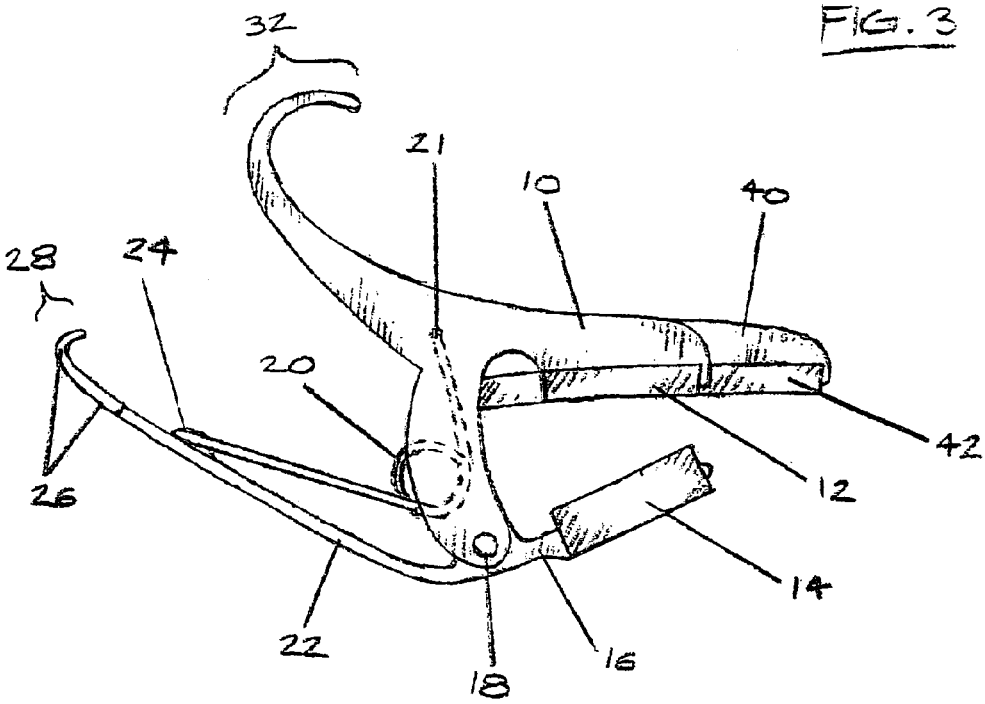
FIG. 3 is the short cut capo side view of FIG. 1.
Figure 4:
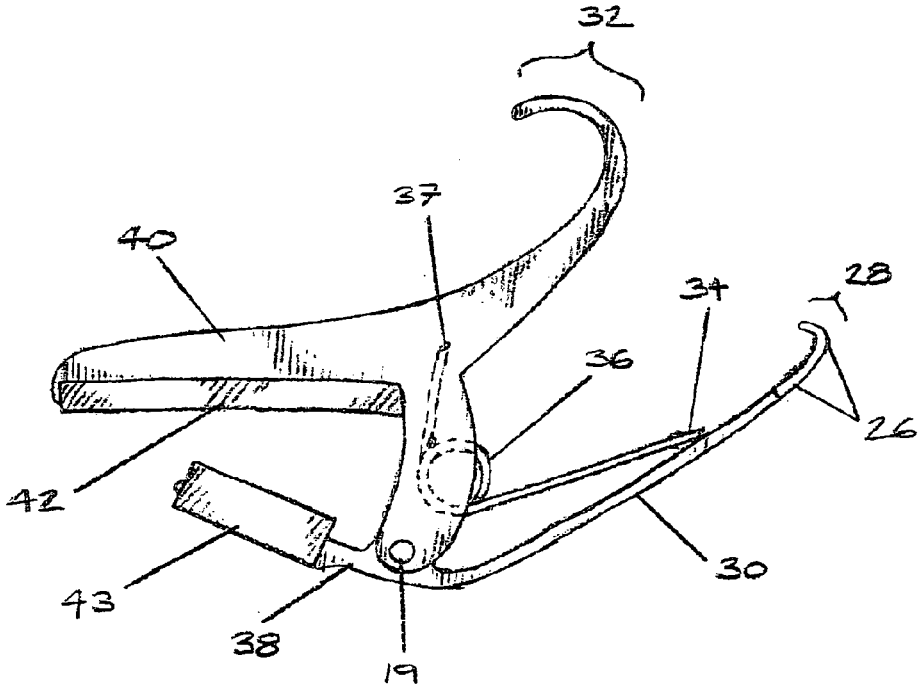
FIG. 4 is the regular capo side view of FIG. 1.
Figure 3:
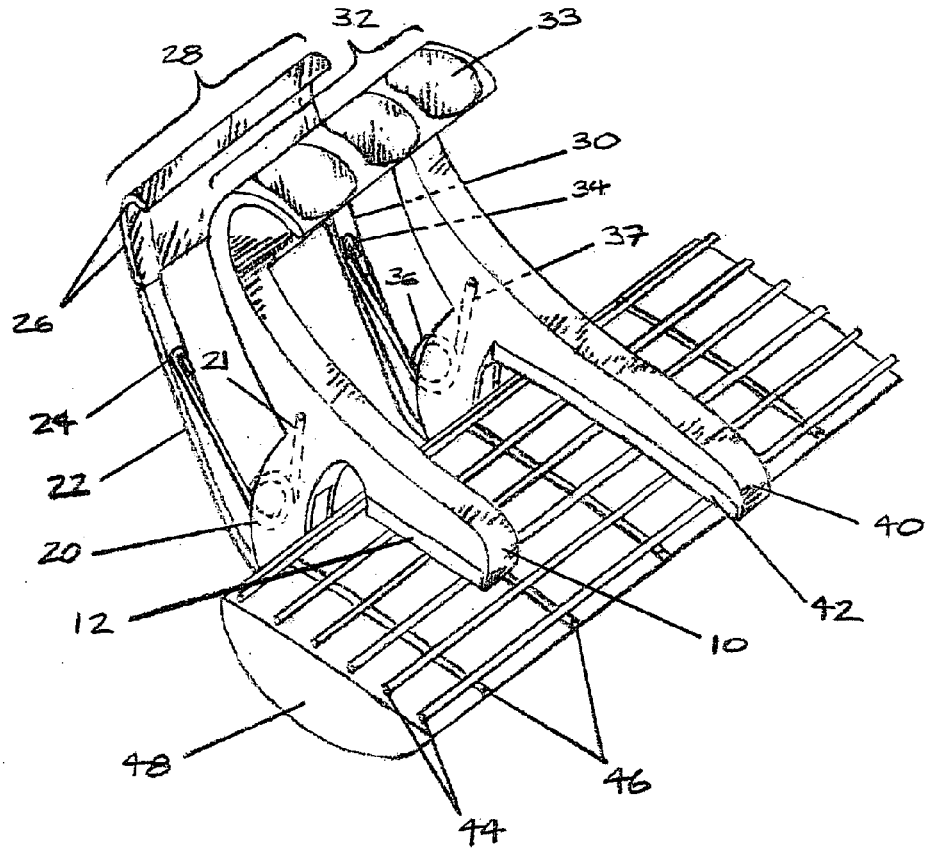
Figure 6:
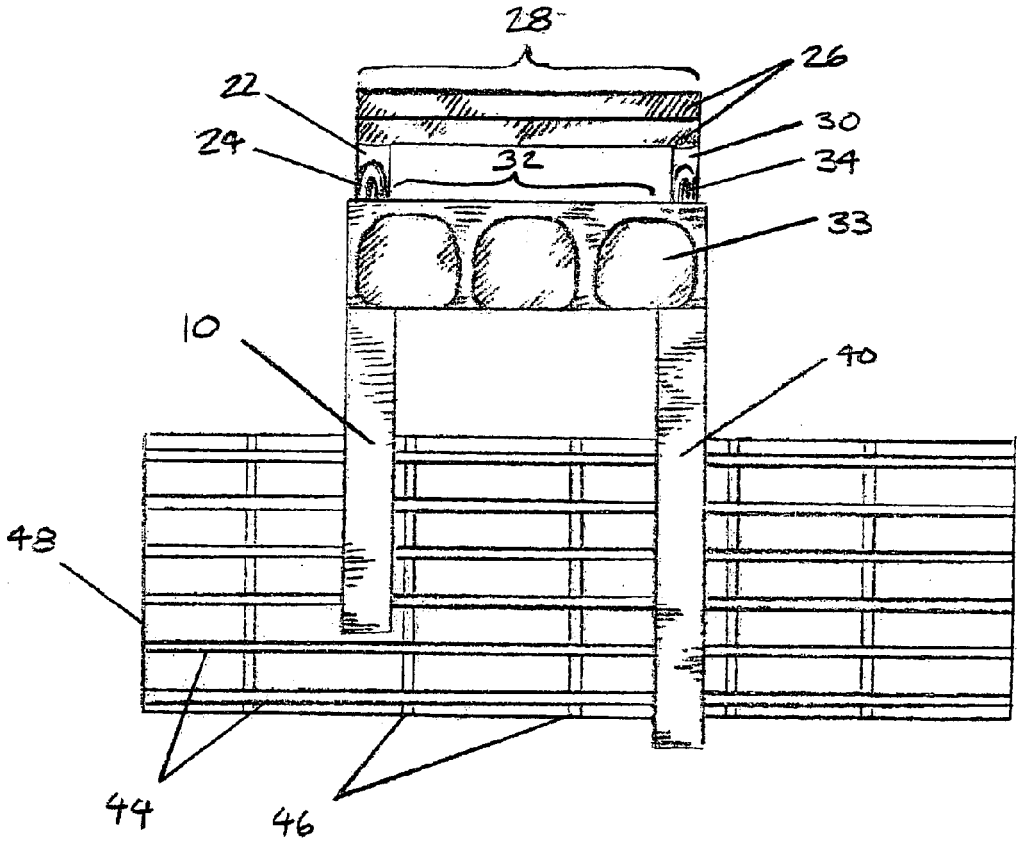
FIG. 6 is a elevational top down view in closed position affixed on the neck of the guitar.
Figure 7:
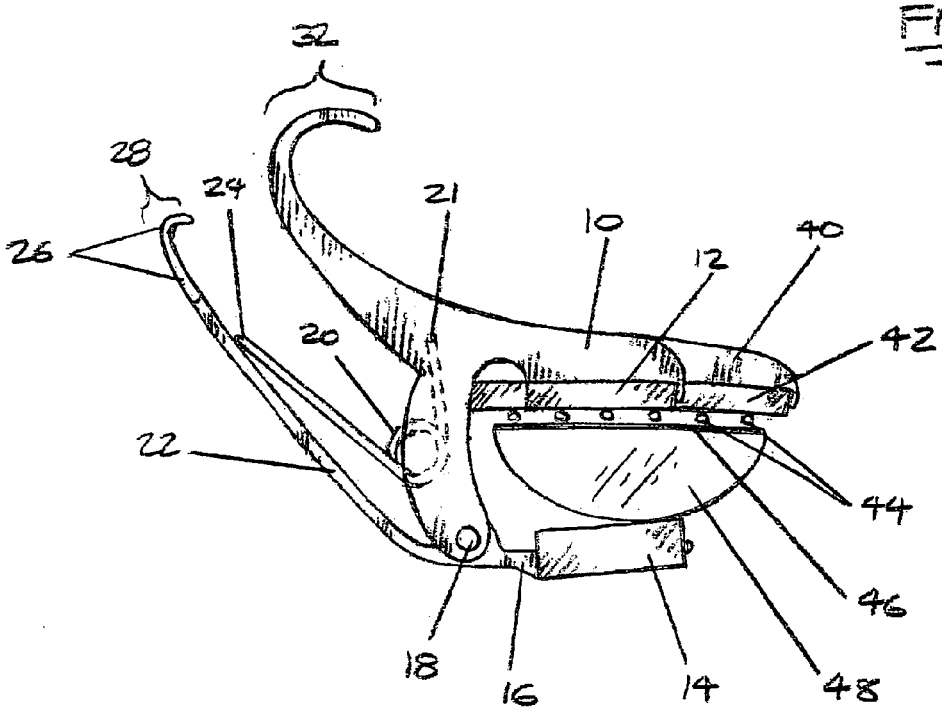
FIG. 7 is the short cut capo side view of FIG. 1 in closed position affixed on the neck of the guitar.

FIGS. 3 and 4 show both jaws at its closed position and FIGS. 7 and 8 show both jaws in its open position. In using the capo of the present invention, the musician grasps the plurality of attachments 28 and 32 and squeezes both plurality of attachments simultaneously, by either the right hand or left hand. Typically the elastomeric pads 26 bears against the palm of of the musicians hand, while three fingers grasp plurality of attachment 32 at grooves 33. When both plurality of attachments (28 and 32) are squeezed simultaneously, the pressure results in top jaws 10 and 40 and bottom jaws 16 and 38 to move away from one another to provide a greater gap to recieve the neck. The entire capo 8 is then moved to recieve the neck 48 of the guitar which is caused to move into the gap with the top jaws 10 and 40 to be positioned above the strings 44 of the guitar. The manual pressure of the musician's hand applied to the plurality of attachments 28 and 32 is then released, allowing the coiled springs 20 and 36 to urge the top jaws 10 and 40 and bottom jaws 16 and 38 to abutting relation with the opposite side of the neck 48. The strings 44 are simultaneously forced into engagement with the fret board 46 of the guitar. Due to the elastormeric pads 42, 43, 12 and 14, the entire capo is prevented from sliding off the neck. When it is desired to reposition the capo system along the neck 48 of the guitar or to remove the capo system from the neck 48 of the guitar, the plurality of attachments 28 and 32 are grasped and squeezed in a manner previously described to cause the top jaws 40 and 10 and bottom jaws 38 and 16 to move to a release position.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A Capo System for a stringed musical instrument having a neck, an extended fret board, and a plurality of strings extending in spaced parallel relation longitudinally in a plane generally parallel to and space from the fret board along the length of the fret board comprising:

a clamp means including an first upper jaw member with an upwardly projecting portion, a horizontal string engaging portion for clamping down selected strings of the musical instrument against at least one fret of the musical instrument, and a downwardly projecting appendage which combines with the horizontal string engaging portion to create a downwardly facing recess for receiving the neck of the musical instrument;

a first lower jaw member with an opposite protruding portion which is joined to said downwardly projecting appendage at a pivot point intermediate the clamping end and handle end, said opposite protruding handle is angled away from said upwardly projecting portion of said upper jaw member and said opposite protruding portion and said upwardly projecting portion combining to form a actuating mechanism for moving the clamp means between a neck clamping position and a non-clamping position;

a second upper jaw member with an upwardly projecting portion, a horizontal string engaging portion for clamping down selected strings of the musical instrument against at least one fret of the musical instrument, and a downwardly projecting appendage which combines with the horizontal string engaging portion to create a downwardly facing recess for receiving the neck of the musical instrument; said second upper jaw is altered in a way that allows the clamping down on selected strings on the neck of the musical instrument while leaving certain strings unclamped;

a second lower jaw member with an opposite protruding portion which is joined to said downwardly projecting appendage at a pivot point intermediate the clamping end and handle end, said opposite protruding portion is angled away from said upwardly projecting portion of said upper jaw member and said opposite protruding portion and said upwardly projecting portion combining to form a actuating mechanism for moving the clamp means between a neck clamping position and a non-clamping position; and biasing means for normally urging the clamping means toward the neck clamping position.

2. The capo system in claim 1, wherein said horizontal string engaging portion of said first upper jaw member, said second upper jaw member, said first jaw member and said second lower jaw member is lined with elastomeric pads for contacting selected strings on the neck of the musical instrument and the bottom of the neck of the musical instrument.

3. The capo system in claim 1, wherein said biasing means is a coil torsion spring which is mounted within said recess in the downwardly projecting appendage and which has a hook end attached to a raised portion of both said opposite protruding portions.

4. The capo system in claim 1, wherein said first upper jaw member with said upwardly projecting portion and said second upper jaw member with said upwardly projecting portion are connected together by a plurality of attachments.

5. The capo system in claim 1, wherein said first lower jaw member with said opposite protruding portion and second lower jaw member with said opposite protruding portion are connected together by a plurality of attachments.

6. The capo system in claim 1, wherein said plurality of attachments are lined with elastomeric pads.

7. The plurality of attachments in claim 4, wherein said plurality of attachments have depression grooves.

8. The capo system in claim 1, wherein said biasing means is a coil torsion spring which is mounted within a recess in said downwardly projecting leg and which has a hook end attached to a raised portion of both said opposite protruding portions.

9. The capo system in claim 1, wherein the pivot points at which said first and second lower jaw members are rotatably joined to both said downwardly projected appendages are on an outer extent of both said downwardly projected appendages, whereby the neck of the musical instrument can be received within both said downwardly facing recess without laterally deflecting the strings thereof.

* * * * *